US009210980B2

(12) United States Patent
Kowalski

(10) Patent No.: US 9,210,980 B2
(45) Date of Patent: Dec. 15, 2015

(54) HAIR FASTENING DEVICE AND METHOD OF USE

(76) Inventor: Deanna Kowalski, Bloomfield, MI (US)

( * ) Notice: Subject to any disclaimer, the term of this patent is extended or adjusted under 35 U.S.C. 154(b) by 0 days.

(21) Appl. No.: 13/184,188

(22) Filed: Jul. 15, 2011

(65) Prior Publication Data

US 2012/0012132 A1 Jan. 19, 2012

Related U.S. Application Data

(60) Provisional application No. 61/339,668, filed on Jul. 15, 2010.

(51) Int. Cl.
*A45D 8/22* (2006.01)
*A45D 8/26* (2006.01)

(52) U.S. Cl.
CPC ..... *A45D 8/26* (2013.01)

(58) Field of Classification Search
CPC ..... A45D 8/24; A45D 8/26; A45D 8/28; A45D 8/32; A45D 8/14; Y10T 24/44274; Y10T 24/44778
USPC ..... 132/276, 278, 279, 273, 277, 280, 284; 24/556, 563, 461, 543
See application file for complete search history.

(56) References Cited

U.S. PATENT DOCUMENTS

| | | | | | |
|---|---|---|---|---|---|
| 1,148,292 | A | * | 7/1915 | Davey | 132/278 |
| 1,443,443 | A | * | 1/1923 | Tanner | 132/278 |
| 1,704,737 | A | * | 3/1929 | Goodman et al. | 132/278 |
| 1,864,199 | A | * | 6/1932 | Kahn | 63/43 |
| 2,106,561 | A | * | 1/1938 | Beiter | 132/278 |
| 2,262,060 | A | * | 11/1941 | Solomon | 132/144 |
| 2,661,748 | A | * | 12/1953 | Racho | 132/275 |
| 2,767,721 | A | * | 10/1956 | Cockley | 132/278 |
| 3,595,249 | A | | 7/1971 | Solomon | |
| 3,705,591 | A | | 12/1972 | Jennis | |
| 5,261,428 | A | | 11/1993 | Wu | |
| 5,634,480 | A | | 6/1997 | Lu | |
| 2004/0182412 | A1 | | 9/2004 | Vogel | |
| 2006/0162738 | A1 | | 7/2006 | Chudzik | |
| 2006/0174909 | A1 | * | 8/2006 | Vestal et al. | 132/280 |

OTHER PUBLICATIONS

International Search Report & Written Opinion dated Mar. 28, 2012; International Application No. PCT/US2011/044228.
Copending U.S. Appl. No. 29/397,461.

* cited by examiner

*Primary Examiner* — Todd E Manahan
*Assistant Examiner* — Brianne Kalach
(74) *Attorney, Agent, or Firm* — The Dobrusin Law Firm, PC

(57) ABSTRACT

A hair fastening device including a spring arm and pressuring curve for maintaining the fastening device in a desired location in a user's hair.

13 Claims, 4 Drawing Sheets

HAIR FASTENING DEVICE AND METHOD OF USE

CLAIM OF PRIORITY

This application claims the benefit of the filing date of U.S. Provisional Application No. 61/399,668, filed on Jul. 15, 2010, the contents of which are incorporated by reference herein for all purposes.

FIELD OF THE INVENTION

The present teachings relate to a device for secure fastening of hair that substantially resists being removed from the hair without intentionally unfastening the device.

BACKGROUND OF THE INVENTION

Barrettes are commonly used for both decorative purposes and to provide a means for maintaining a portion of a user's hair in a particular location. A common issue with barrettes is their propensity to shift location after fastening or even become unfastened during use. As a result, many barrettes fail to adequately perform the function of maintaining hair in a particular position. Further, many barrettes may shift substantially or even fall out of a user's hair if the hair is particularly fine and/or straight, as the barrette is unable to sufficiently grab and remain securely located due to the composition of a user's hair. Often, any physical activity undertaken by a user will cause the barrette to shift from its desired location.

U.S. Pat. No. 3,705,591 discloses a barrette having a hinge and two member assembly. The patent does not disclose the use of any unique features or materials along the two members to maintain the barrette in a fixed location.

U.S. Pat. No. 3,595,249 discloses a barrette with a similar two member assembly. The barrette shown includes a latching fastening mechanism to maintain the barrette in a fastened position.

Notwithstanding the above, there remains a need for a barrette device that can be securely fastened in a location in a user's hair without substantial movement from that location without intentional unfastening of the barrette device for removal.

SUMMARY OF THE INVENTION

The present teachings address one or more of the above needs by providing a hair fastening device comprising a spring portion, a pad surface, a spring arm, and a first and second compression end. The pad surface may be located adjacent and attached to the spring portion. The spring arm may be located adjacent the spring portion and substantially opposing the pad surface. The spring arm may include a spring arm coating located in direct planar contact with at least a portion of the spring arm. The first compression end may be located at an end of the pad surface. The second compression end may be located at an end of the spring arm so that the second compression end contacts the first compression end during use of the device.

In another aspect, the present teachings contemplate a device for placement in a user's hair comprising a springing portion, a holding arm, a forcing arm, a first compressing end including a pressuring curve, and a second compressing end. The holding arm may be located adjacent and attached to the springing portion. The forcing arm may force device contents toward the holding arm and may be located adjacent the springing portion and substantially opposing the holding arm.

The first compressing end may be located at a terminal end of the holding arm. The second compressing end may contact a portion of the pressuring curve and may be located at a terminal end of the forcing arm.

The teachings herein may also contemplate a device for placement in a user's hair comprising a springing portion for creating a downward force and a holding arm located adjacent and attached to the springing portion, at least a portion of the holding arm including a gripping material. The device may further include a forcing arm for forcing device contents toward the holding arm, the forcing arm including a forcing arm coating and located adjacent the springing portion and substantially opposing the holding arm. The device may also include a first compressing end including a pressuring curve and located at a terminal end of the holding arm. The pressuring curve may form a U-shape having a first side and second side. The pressuring curve may create an upward force. The device may also include a second compressing end for contacting the first side of the U-shape of the pressuring curve and experiencing the upward force created by the pressuring curve, the second compressing end located at a terminal end of the forcing arm.

The device of the present teachings provides for a hair fastening device that resists movement once located in a user's hair and fastened. The components of the device are shaped to exert forces upon one another during use of the device so that the device resists fall out during use. In addition, various gripping materials and/or coatings are located onto the device to improve the ability of the device components to grip one another and also improve the device's ability to grip a user's hair during use.

DETAILED DESCRIPTION

Figure 1:
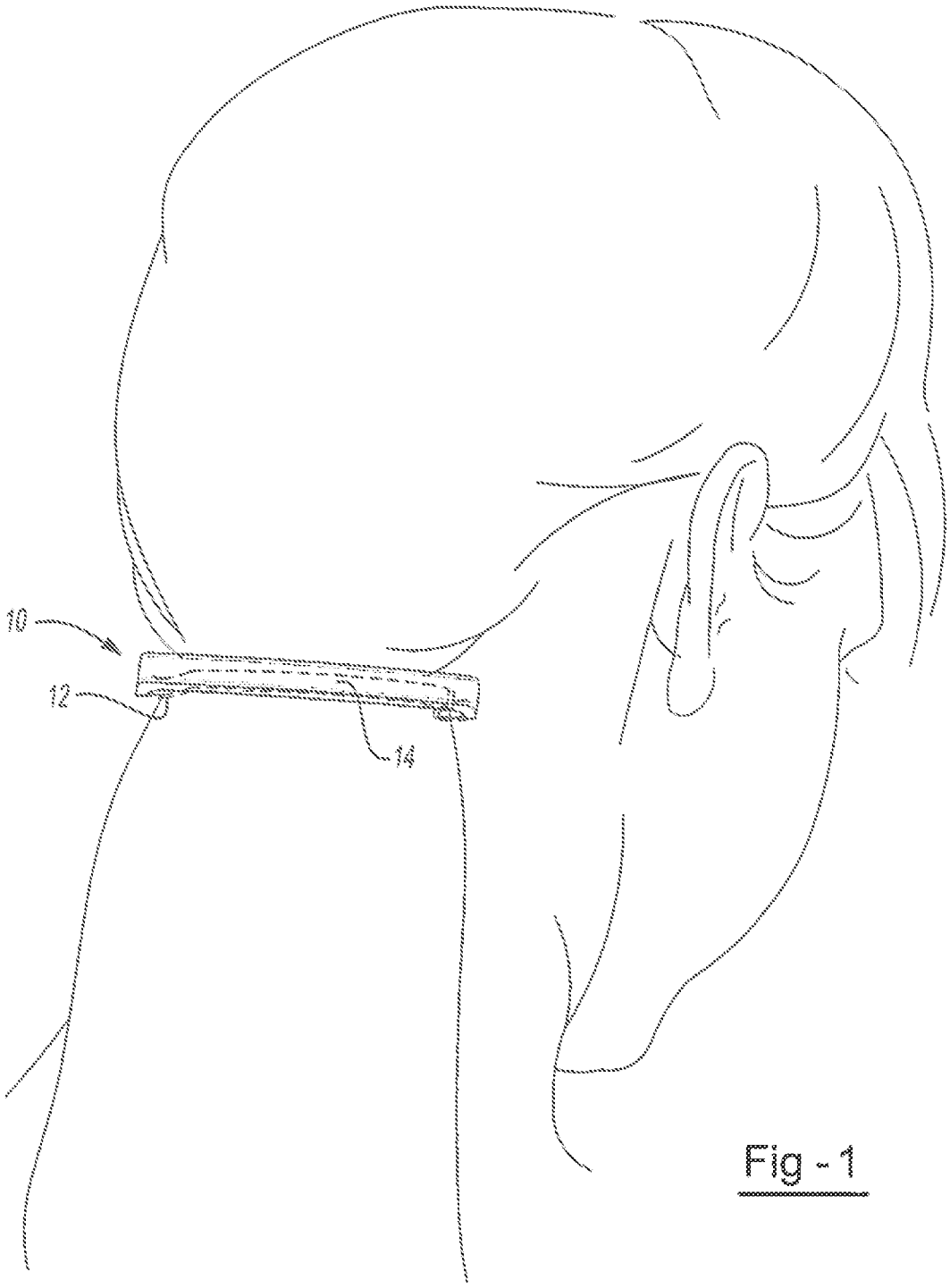
FIG. 1 is a perspective view of an illustrative example of a device in accordance with the present teachings shown in use.

The device disclosed herein includes a combination of components and materials to provide a barrette that substantially maintains its position in a user's hair upon fastening of the barrette. One or more components of the device are formed to create forces that act upon other components when the device is fastened so that the device maintains its intended position during use. As an example, the device may include a spring portion (e.g., a springing portion) having a curved profile, such that the springing portion curves upward. The upward curve of the springing portion may extend into a spring arm (e.g., a forcing arm) that curves slightly downward. The shape of the springing portion and downward extension of the forcing arm causes a downward force to be exerted on the forcing arm.

The device may further include a pad surface (e.g., a holding arm) located in a generally opposing relationship with the forcing arm and adjacent the springing portion. The holding arm may include a first compressing end located at a terminal end of the holding arm and at the opposite end of the springing portion. The first compressing end may include a pressuring curve. The pressuring curve may be curved in shape so that upon fastening the device, the pressuring curve may exert an upward force on a terminating end (e.g., a second compressing end) of the forcing arm. During fastening of the device, the second compressing end may be located into contact with (e.g., located above) the pressuring curve. Thus, the upward force created by the pressuring curve may oppose the downward force exerted by the springing portion and forcing arm.

The pressuring curve may be formed in a curved shape. The pressuring curve may be formed generally in a U-shape. The U-shape form may increase the upward pressure exerted on the second compressing end when the device is in a fastened position. The U-shape may have a first edge (e.g., a top edge) and a second edge (e.g., a bottom edge) so that the second compressing end contacts the first edge of the pressuring curve when the device is in a fastened position. The pressuring curve may thus push the second compressing end upward toward the holding arm when the device is in a fastened position. Upon contacting the pressuring curve with the second compressing end, the second compressing end may be located less than about 1 mm, less than about 0.7 mm or even less than about 0.5 mm from the underside of the pad surface.

In addition to the shape of various components, the pad surface, springing arm (including the second compressing end), and pressuring curve may be formed of a material or may include a coating that improves the ability of the components to maintain contact with one another and/or maintain contact with a user's hair. As an example, the pad surface and more specifically, the underside of the pad surface may be formed of a gripping material such as a thermoplastic material (e.g., an elastomer) that may increase the friction between the pad surface and a user's hair. The forcing arm and possibly the spring portion and second compressing end may include a spring arm coating which may be a foam material or other polymeric material. The base material of the spring portion, pressuring curve and springing arm may be a rigid material such as a metal or rigid polymeric material. The pressuring curve may be formed of a metal material.

Referring now to FIG. 1 there is shown the device 10 including a spring portion 12 and a pad surface 14. The device 10 is shown in more detail at FIGS. 2 and 3. The spring portion 12 may be located adjacent a spring arm 16. One or more of the spring portion and spring arm may include a spring arm coating 18. A first compression end 20 may be located at a terminal end 34 of the pad surface 14. A second compression end 22 may be located at a terminal end 36 of the spring arm 16. A gripping material 24 may be located onto at least a portion of the pad surface 14. The first compression end 20 may include a curve portion 26. The curve portion 26 may be a substantially U-shaped curve portion having a first side 28 and a second side 30.

Figure 4:
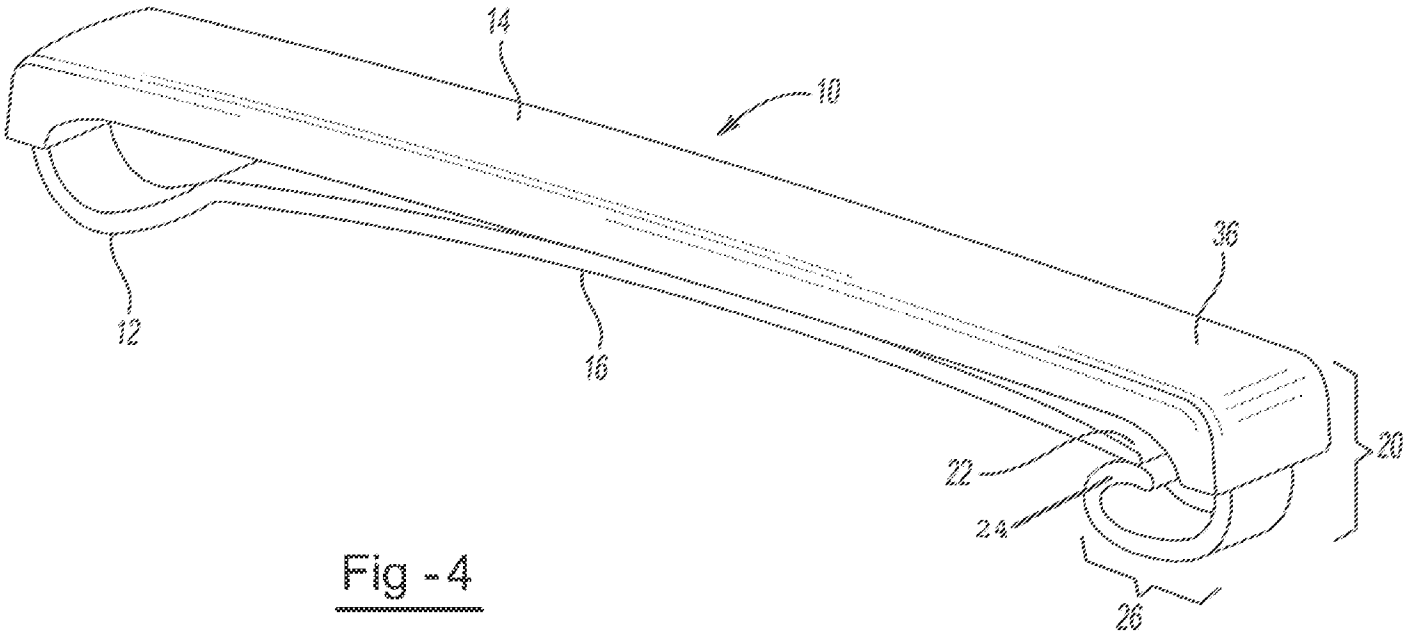
FIG. 4 is a perspective view of the device of FIG. 1 shown in a fastened position.

FIG. 4 depicts an illustrative example of the device 10 in a fastened position. The device 10 includes a springing portion 12 which exerts a downward force on a forcing arm 16 (e.g., a spring arm). The springing portion 12 may be located adjacent a holding arm 14 (e.g., a pad surface) and may exert an upward force on the holding arm 14. A first compressing end 20 may be located at a terminal end 34 of the holding arm 14. A second compressing end 22 may be located at a terminal end 36 of the forcing arm 16. The first compressing end may include a pressuring curve 26. When the device is in a fastened position as shown, the pressuring curve 26 may exert an upward force on the second compressing end 22 that pushes the second compressing end toward the holding arm 14. The force exerted by the pressuring curve 26 may be opposing the downward force exerted by the springing portion 12 on the forcing arm 16.

Figure 5:
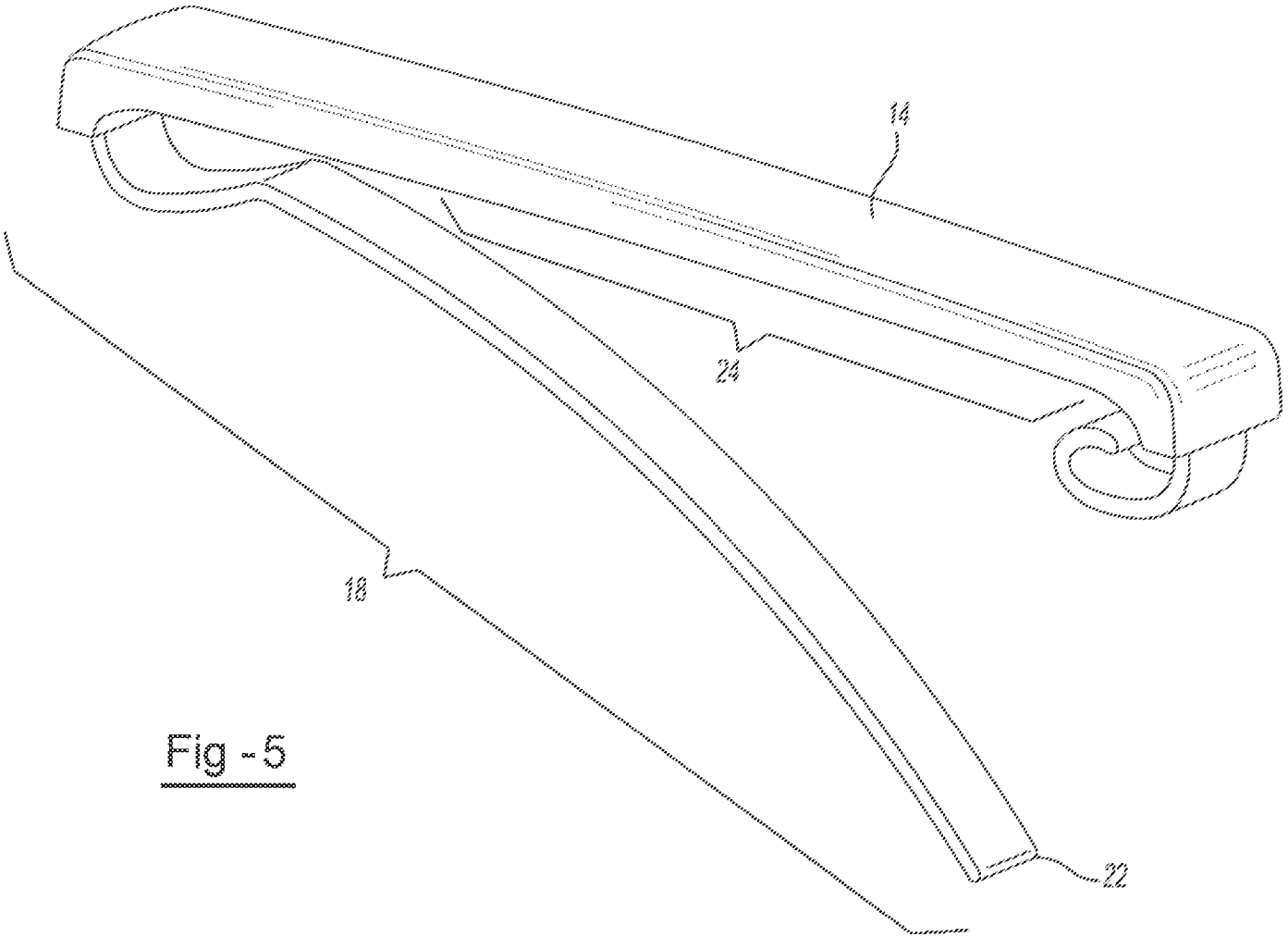
FIG. 5 is a perspective view of the device of FIG. 1 shown in an unfastened position.

In addition to the forces exerted by various components of the device as discussed herein, one or more coatings or materials may contribute to the ability of the device to maintain its position in a user's hair. As an example, at least a portion of the device may include a gripping material. For example, as shown in FIG. 5, all or a portion of the holding arm 14 may be comprised of the gripping material 24. A coating material may also be used. For example, a forcing arm coating 18 may be located onto all of a portion of the forcing arm 16 and second compressing end 22.

Figure 2:
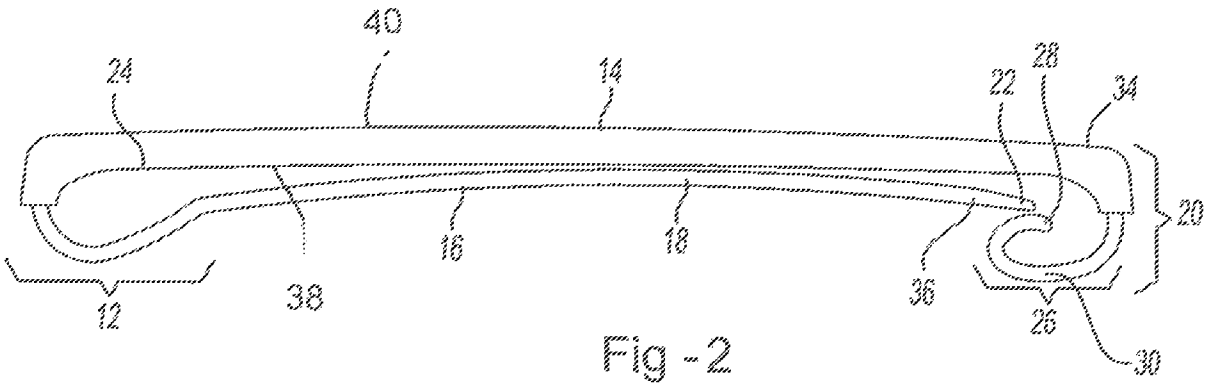
FIG. 2 is a side-profile view of the device of FIG. 1 shown in a fastened position.
Figure 3:
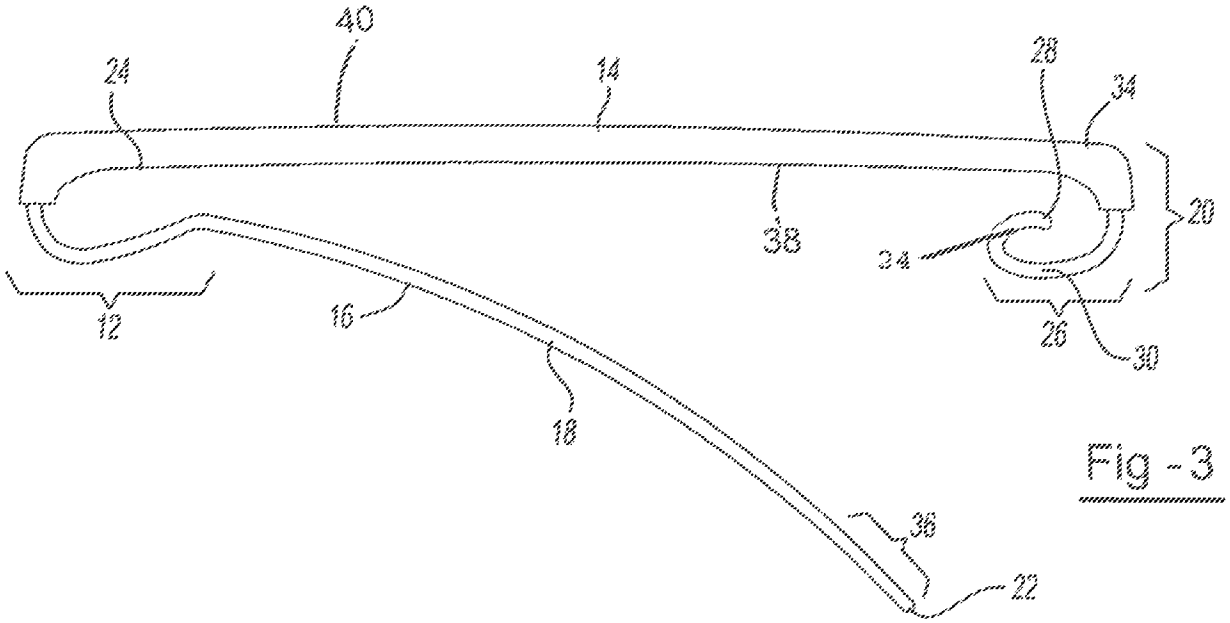
FIG. 3 is a side-profile view of the device of FIG. 1 shown in an unfastened position.

In more detail, referring to the illustrative example device shown at FIGS. 2 and 3, the device 10 as shown may include the spring portion 12 and the pad surface 14 which may have an under-surface 38 that contacts a user's hair during use of the device 10. During use, the device 10 is located in a user's hair, and the spring arm 16 is manually moved into a fastened position so that the second compression end 22 of the device 10 engages the first compression end 20 in a friction interaction. The device 10 may grip onto hair with the aid of the pad under-surface 38 and any gripping material 24 located thereon which interacts with the spring arm 16 and the second compression end 22 of the spring arm 16 to assist in securing the device into place in the hair.

The device may be comprised of any sufficiently rigid, high-strength material including plastics, metals, and the like. The materials utilized for portions that contact a user's hair may be sufficiently textured (e.g, a gripping material) so that the device is held in place with substantially no movement during use of the device. The materials utilized for components of the device that are located into contact with other components may also be sufficiently textured to improve secure and substantially immobile contact between components of the device so that un-fastening is substantially prohibited without intentional unfastening by a user. The pad surface 14 may be composed of any sufficiently flexible and gripping type material such as a plastic, foam, combinations thereof and the like. The top surface 40 of the pad surface 14 may be formed of a different material and may include printed indicia and/or a decorative element that is viewable when the device is located into a user's hair. As such, the various components of the device 10 can be made of differing materials, depending on the function of each component.

As discussed herein, one or more components of the device, including the springing portion, the holding arm, the forcing arm, the pressuring curve and one or more of the first and second compressing ends may be formed of materials that may include polymeric materials including but not limited to thermoplastics, thermoset plastics, elastomeric containing materials or any combination thereof. Examples of polymeric and elastomeric materials that may be employed include nylon, polyvinyl chloride, polypropylene, high-density polyethylene, low-density polyethylene, linear low-density polyethylene, polyvinylidene chloride polyamide, polyester, polystyrene, polyethylene, polyethylene terephthlate, bio-based plastics/biopolymers (e.g., poly lactic acid), silicone, acrylonitrile butadiene styrene (ABS), rubber, polyisoprene, butyl rubber, polybutadiene, EPM rubber, EPDM rubber, or any combination thereof. Additional suitable materials may include bio-plastics such as those derived from wood pulp-based lignin (e.g., liquid wood), sugarcane or other petroleum-free moldable materials. One or more of these components may be formed of a metallic material.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

The invention claimed is:

1. A hair fastening device comprising:

a spring portion;

a metallic pad surface located adjacent and attached to the spring portion;

a metallic spring arm located adjacent the spring portion and substantially opposing the pad surface;

wherein the pad surface contains an elastomeric gripping material substantially enclosing the entirety of the metallic portion of the pad surface, and wherein the spring portion exerts a downward force on the metallic spring arm and the metallic spring arm is free of the elastomeric gripping material so that when the hair fastening device is in a fastened position, a user's hair is in contact with the metallic portion of the spring arm and the elastomeric gripping material of the pad surface, a first compression end located at an end of the pad surface, the first compression end including a pressuring curve comprising a elastomeric gripping material;

wherein the pressuring curve exerts an upward force that opposes the spring portion's downward force;

a second compression end located at an end of the spring arm so that the second compression end lies in direct planar contact with the elastomeric gripping material of the pressuring curve so that: the elastomeric gripping material of the pad surface, the elastomeric material of the pressuring curve, the upward force of the pressuring curve and the downward force of the spring portion substantially prevents movement of the device when located in a user's hair.

2. The device of claim 1, wherein the first compression end including the entire pressuring curve is coated with the elastomeric gripping material.

3. The device of claim 1, wherein the elastomeric gripping material of the first compression end contacts the second compression end when the device is in a fastened position so that a point of contact exists between the first and second compression ends and the location of the point of contact does not move when the device is in use.

4. The device of claim 1, wherein the pad surface includes a pad under surface that is coated with the elastomeric gripping material.

5. The device of claim 1, wherein the pad surface includes a pad under surface coated with the elastomeric gripping material and wherein the pad surface is located less than about 1 mm from the second compression end when the device is in a fastened position.

6. The device of claim 1, wherein a portion of the spring portion is metallic and a portion of the spring portion is enclosed in the elastomeric gripping material.

7. The device of claim 1, wherein the elastomeric gripping surface on the pressuring curve creates substantially immobile contact between the pressuring curve and second compression end such that un-fastening is prohibited without intentional unfastening by the user.

8. A device for placement in a user's hair comprising:

a springing portion that exerts a downward force;

a holding arm having an elastomeric gripping material located onto a metallic material for gripping a user's hair when in use and covering substantially the entirety of the holding arm and located adjacent and attached to the springing portion;

a forcing arm which is free of a gripping material for forcing device contents toward the holding arm located adjacent the springing portion and substantially opposing the holding arm;

a first compressing end including a pressuring curve including an elastomeric material and located at a terminal end of the holding arm, wherein the pressuring curve exerts an upward force;

a second compression end located at an end of the spring arm so that the second compression end lies in direct planar contact with the first compressing end so that the combination of the elastomeric gripping material of the holding arm and pressuring curve, the upward force of the pressuring curve and the downward force of the springing portion substantially prevents movement of the device when located in a user's hair.

9. The device of claim 8, wherein upon locating the device in a fastened position, the second compressing end is pushed toward the holding arm so that the second compressing end is located into contact with the pressuring curve.

10. The device of claim 9, wherein the downward force is created by the springing portion and experienced by the forcing arm and compression end so that the downward force opposes the upward force created by the pressuring curve.

11. The device of claim 8, wherein the pressuring curve is integrally formed with the holding arm of the elastomeric gripping material.

12. The device of claim 8, wherein a portion of the spring portion is metallic and a portion of the spring portion is enclosed in the elastomeric gripping material.

13. The device of claim 8, wherein the elastomeric gripping surface on the pressuring curve creates substantially immobile contact between the pressuring curve and second compression end such that un-fastening is prohibited without intentional unfastening by the user.

* * * * *